US010500840B2

(12) United States Patent
Umezawa et al.

(10) Patent No.: US 10,500,840 B2
(45) Date of Patent: Dec. 10, 2019

(54) PRINTING APPARATUS AND CONTROL METHOD THAT CONTROL MOVEMENT OF A TRANSFER MEMBER

(71) Applicant: CANON KABUSHIKI KAISHA, Tokyo (JP)

(72) Inventors: Masahiko Umezawa, Kawasaki (JP); Satoshi Kitai, Kawasaki (JP); Kouichi Serizawa, Yokohama (JP); Atsushi Takahashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/925,856

(22) Filed: Mar. 20, 2018

(65) Prior Publication Data

US 2018/0281382 A1 Oct. 4, 2018

(30) Foreign Application Priority Data

Mar. 28, 2017 (JP) ..... 2017-063749

(51) Int. Cl.
*B41J 2/01* (2006.01)
*B41J 2/03* (2006.01)
(Continued)

(52) U.S. Cl.
CPC ..... *B41J 2/0057* (2013.01); *B41J 2/01* (2013.01); *B41J 2/03* (2013.01); *B41J 2/125* (2013.01);
(Continued)

(58) Field of Classification Search
CPC ..... B41J 2/005; B41J 2/01; B41J 2/03; B41J 2/125; B41J 2/155; B41J 2/14024; B41J 13/0018; B41J 2002/012
(Continued)

(56) References Cited

U.S. PATENT DOCUMENTS 5,223,858 A * 6/1993 Yokoi ..... B41J 13/0018 346/104
5,372,852 A 12/1994 Titterington et al.
(Continued)

FOREIGN PATENT DOCUMENTS

CN 1050097 A 3/1991
CN 1055897 A 11/1991
(Continued)

OTHER PUBLICATIONS

Extended European Search Report dated Jul. 31, 2018, in European Application No. 18000228.9.

*Primary Examiner* — Stephen D Meier
*Assistant Examiner* — Alexander D Shenderov
(74) *Attorney, Agent, or Firm* — Venable LLP

(57) ABSTRACT

A printing apparatus includes a control unit that, when continuously printing on a plurality of cut sheets of a same size, controls a print unit to cause a transfer member to continue movement, controls the print unit and a supply unit so as to stop supply of a cut sheet by the supply unit based on information concerning a time taken to process image data representing an image of a print target by an image processing unit, and controls the print unit not to form an ink image in a partial area on the transfer member that passes through a transfer area at a timing when the supply of the cut sheet to the transfer area is stopped, and to form the ink image in a remaining area.

23 Claims, 16 Drawing Sheets

(51) Int. Cl.

| | |
|---|---|
| ***B41J 2/14*** | (2006.01) |
| ***B41J 2/21*** | (2006.01) |
| ***B41J 13/00*** | (2006.01) |
| ***B41J 2/005*** | (2006.01) |
| ***B41J 2/125*** | (2006.01) |
| ***B41J 2/155*** | (2006.01) |

(52) U.S. Cl.
CPC ..... *B41J 2/14024* (2013.01); *B41J 2/155* (2013.01); *B41J 2/211* (2013.01); *B41J 13/0018* (2013.01); *B41J 2002/012* (2013.01)

(58) Field of Classification Search
USPC ..... 347/103
See application file for complete search history.

(56) References Cited

U.S. PATENT DOCUMENTS

| | | | | |
|---|---|---|---|---|
| 5,455,603 | A | 10/1995 | Hori et al. | |
| 6,125,242 | A | 9/2000 | Yamada | |
| 6,282,388 | B1 | 8/2001 | Obata | |
| 6,364,442 | B1 | 4/2002 | Kawase et al. | |
| 6,494,570 | B1 | 12/2002 | Snyder | |
| 6,631,986 | B2 | 10/2003 | Silverbrook | |
| 7,661,809 | B2 | 2/2010 | Taniuchi et al. | |
| 2003/0085975 | A1 | 5/2003 | Silverbrook | |
| 2006/0001722 | A1* | 1/2006 | Stelter ..... | B41J 2/0057 347/103 |

FOREIGN PATENT DOCUMENTS

| | | | |
|---|---|---|---|
| CN | 1188913 | A | 7/1998 |
| CN | 1215187 | A | 4/1999 |
| CN | 105711251 | A | 6/2016 |
| JP | S60-157874 | A | 8/1985 |
| JP | 2005-153187 | A | 6/2005 |

* cited by examiner

FIG. 10

| No. | MODE | NUMBER OF COPIES |
|---|---|---|
| 1 | IMAGE 1 | N |
| 2 | IMAGE 2 | 1 |
| 3 | IMAGE 3 | N |
| 4 | IMAGE 4 | 1 |
| 5 | IMAGE 5 | 1 |
| 6 | IMAGE 3 | 1 |
| ⋮ | ⋮ | ⋮ |
| XX-1 | IMAGE G | 1 |
| XX | END | 0 |

FIG. 11

| No. | MODE | NUMBER OF COPIES |
|---|---|---|
| 1 | IMAGE 1 | 1 |
| 2 | Non | 3 |
| 3 | IMAGE 2 | 1 |
| 4 | Non | 3 |
| 5 | IMAGE 3 | 2 |
| 6 | Non | 2 |
| 7 | IMAGE 4 | 1 |
| 8 | IMAGE 5 | 1 |
| 9 | IMAGE 6 | 1 |
| 10 | IMAGE 7 | 1 |
| ⋮ | ⋮ | ⋮ |
| XX-1 | IMAGE G | 1 |
| XX | END | 0 |

FIG. 12

| No. | MODE | NUMBER OF COPIES | RESOLUTION |
|---|---|---|---|
| 1 | IMAGE 1 | 1 | 600 |
| 2 | Non | 3 | 0 |
| 3 | IMAGE 2 | 1 | 1200 |
| 4 | Non | 3 | 0 |
| 5 | IMAGE 3 | 2 | 1200 |
| 6 | Non | 2 | 0 |
| 7 | IMAGE 4 | 1 | 1200 |
| 8 | IMAGE 5 | 1 | 600 |
| 9 | IMAGE 6 | 1 | 600 |
| 10 | IMAGE 7 | 1 | 600 |
| ⋮ | ⋮ | ⋮ | ⋮ |
| XX-1 | IMAGE G | 1 | 600 |
| XX | END | 0 | 0 |

FIG. 17A

| | FIRST ROTATION | | | | SECOND ROTATION | | | | THIRD ROTATION | | | | FOURTH ROTATION | | | |
|---|---|---|---|---|---|---|---|---|---|---|---|---|---|---|---|---|
| PRINT TARGET | IMAGE 1 | IMAGE 1 | IMAGE 1 | IMAGE 1 | IMAGE 2 | IMAGE 3 | IMAGE 3 | IMAGE 3 | IMAGE 3 | IMAGE 4 | IMAGE 1 | IMAGE 5 | IMAGE 6 | IMAGE 7 | IMAGE 8 | IMAGE 9 |
| APPARATUS STATE | PRINT -ING | PRINT -ING | PRINT -ING | PRINT -ING | PRINT -ING | PRINT -ING | PRINT -ING | PRINT -ING | PRINT -ING | PRINT -ING | PRINT -ING | PRINT -ING | PRINT -ING | PRINT -ING | PRINT -ING | PRINT -ING |
| RESOLUTION | 600 | 600 | 600 | 600 | 600 | 600 | 600 | 600 | 600 | 600 | 600 | 600 | 600 | 600 | 600 | 600 |

FIG. 17B

| | FIRST ROTATION | | | |
|---|---|---|---|---|
| PRINT TARGET | IMAGE 1 | IMAGE 2 | IMAGE 3 | IMAGE 4 |
| APPARATUS STATE | PRINTING | PRINTING | PRINTING | PRINTING |
| RESOLUTION | 600 | 1200 | 600 | 1200 |

PRINTING APPARATUS AND CONTROL METHOD THAT CONTROL MOVEMENT OF A TRANSFER MEMBER

This application claims the benefit of Japanese Patent Application No. 2017-063749, filed on Mar. 28, 2017, which is hereby incorporated by reference in its entirety.

BACKGROUND OF THE INVENTION

Field of the Invention

The present invention relates to a technique of transferring an ink image to a print medium.

Description of the Related Art

In a printing system for transferring an ink image to a print medium, various processes for forming an image to be transferred are performed (see Japanese Patent Laid-Open No. 2005-153187). The processing time of these processes increases in proportion to the size of a processed image. For example, with respect to images of the same paper size, the amount of data to be processed for an image of 1,200 dots per inch (dpi) is four times greater than that for an image of 600 dpi. Thus, the processing time can increase up to about four times.

Some processing apparatuses can complete, for an image having a resolution equal to or less than a predetermined value, such as 600 dpi, the above-described processes within a predetermined period related to processing of transferring an image to a print medium but may not be able to complete the processes within the predetermined period for an image having a resolution exceeding the predetermined value. In this case, control of a mechanism of transferring an image to a print medium may become complicated.

SUMMARY OF THE INVENTION

The present invention provides a system that simply and appropriately transfers an image to a print medium in accordance with the capability of an apparatus for processing print target data.

According to one aspect, the present invention provides a printing apparatus comprising a transfer member configured to move to cyclically pass through a formation area of an ink image and a transfer area in which the ink image is transferred to a cut sheet, a supply unit configured to supply the cut sheet to the transfer member continuously, a data acquisition unit configured to acquire print data for forming the ink image on the transfer member, that is obtained when an image processing unit processes data representing an image of a print target, a print unit configured to discharge ink to the transfer member based on the print data and form the ink image on the transfer member in the formation area of the ink image, and a transfer unit configured to transfer the ink image from the transfer member to the cut sheet supplied by the supply unit in the transfer area, wherein the transfer member is provided so as to be capable of holding images of a plurality of cut sheets in a direction in which the transfer member passes through the formation area of the ink image, and the printing apparatus further comprises a control unit configured to control, when continuously printing on the plurality of cut sheets of the same size, the print unit and the supply unit so as to stop the supply of the cut sheet by the supply unit based on information concerning a time taken to process image data representing the image of the print target by the image processing unit while continuing the movement of the transfer member, and not to form the ink image in a partial area on the transfer member, that passes through the transfer area at a timing when the supply of the cut sheet to the transfer area is stopped, and to form the ink image in a remaining area.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention, and, together with the description, serve to explain the principles of the invention.

FIG. 10 is a table showing an example of the structure of a print order table.

FIG. 11 is a table showing an example of the structure of a print order table according to an embodiment.

FIG. 12 is a table showing another example of the structure of the print order table according to the embodiment.

FIGS. 17A and 17B are views showing another example of the processing executed by the printing system.

DESCRIPTION OF THE EMBODIMENTS

Exemplary embodiments of the present invention will now be described in detail with reference to the drawings. It should be noted that the relative arrangement of the components, the numerical expressions, and numerical values set forth in these embodiments do not limit the scope of the present invention unless it is specifically stated otherwise.

In each view, arrows X and Y indicate horizontal directions perpendicular to each other. An arrow Z indicates a vertical direction.

Printing System

Figure 1:
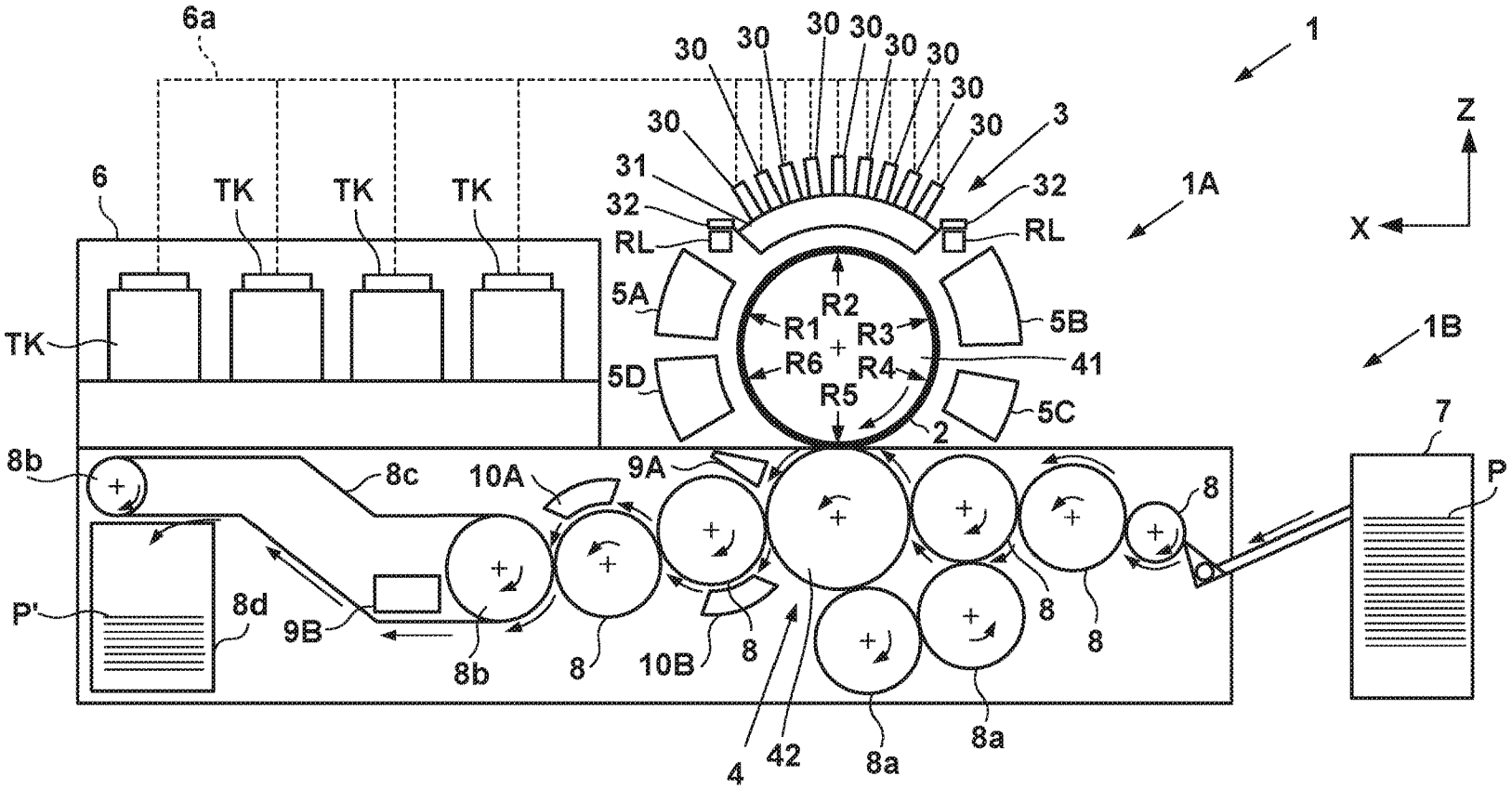
FIG. 1 is a schematic view showing a printing system.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information, such as a character or a graphic pattern, but also formation of an image, design, or pattern on a print medium in a broader sense, or processing of a print medium regardless of whether the information is significant or insignificant or has become obvious to allow human visual perception. In this embodiment, a "print medium" is assumed to be a paper sheet, but may be a fabric, plastic film, or the like.

An ink component is not particularly limited. In this embodiment, however, a case is assumed in which water-soluble pigment ink that includes a pigment as a coloring material, water, and a resin is used.

Printing Apparatus

The printing apparatus 1A includes a print unit 3, a transfer unit 4, peripheral units 5A to 5D, and a supply unit 6.

Print Unit

Figure 2:
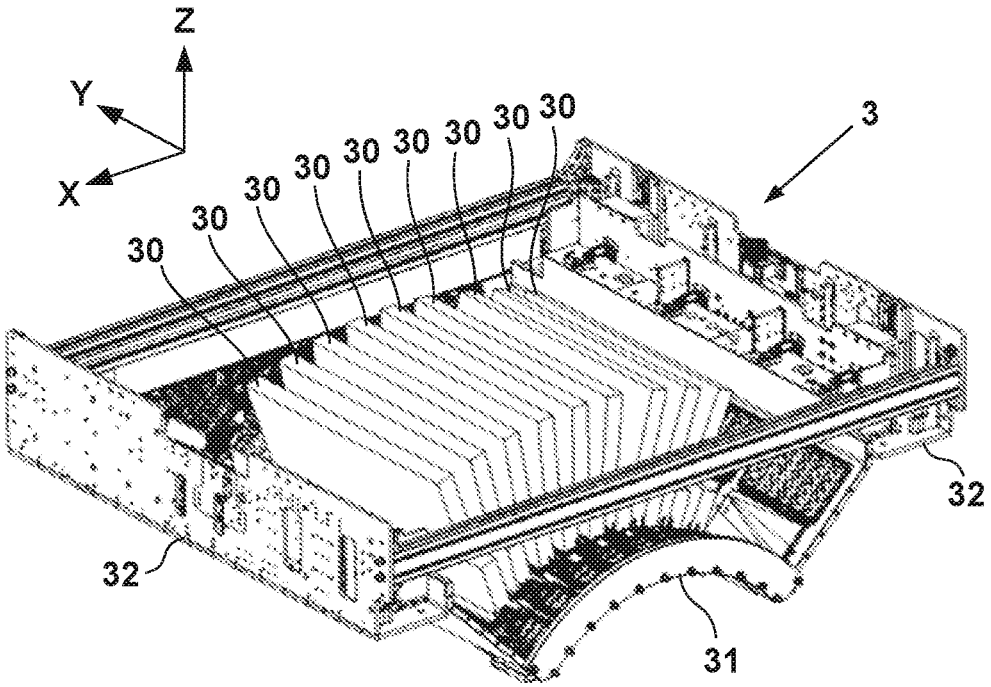
FIG. 2 is a perspective view showing a print unit.

The print unit 3 includes a plurality of printheads 30 and a carriage 31. A description will be made with reference to FIGS. 1 and 2. FIG. 2 is a perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range in which they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus, the plurality of printheads 30 are arranged radially.

Each nozzle includes a discharge element. The discharge element is, for example, an element that generates a pressure in the nozzle and discharges ink in the nozzle, and the technique of an inkjet head in a known inkjet printer is applicable. For example, an element that discharges ink by causing film boiling in ink with an electrothermal transducer and forming a bubble, an element that discharges ink by an electromechanical transducer, an element that discharges ink by using static electricity, or the like, can be used as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. One printhead 30 may, however, be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
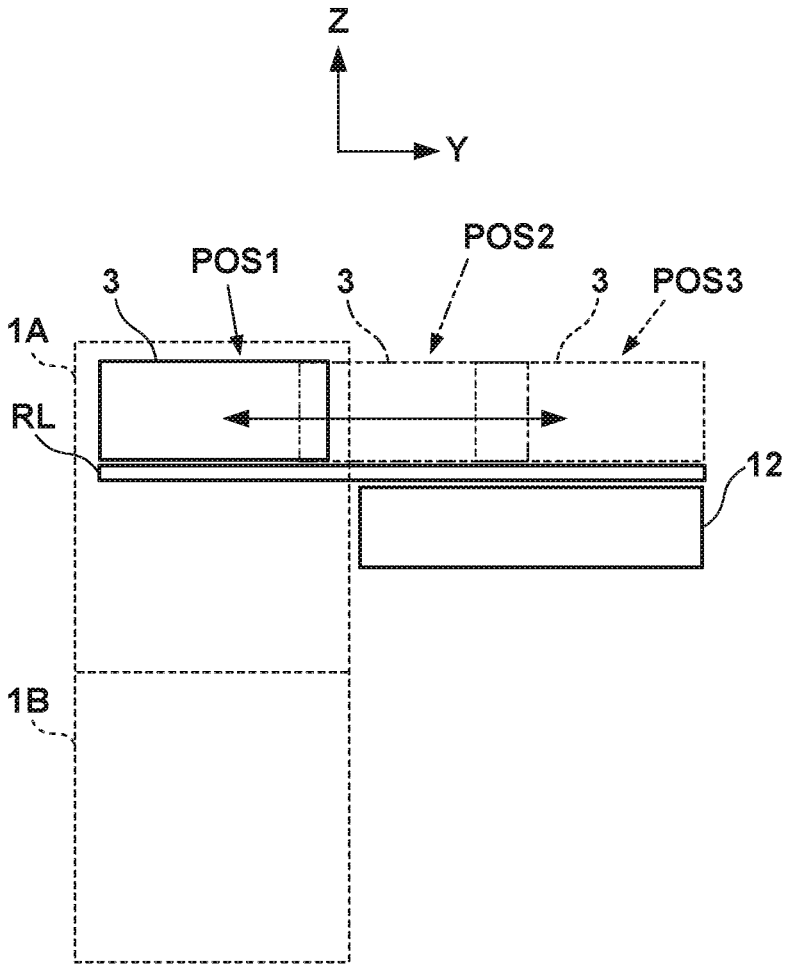
FIG. 3 is an explanatory view showing a displacement mode of the print unit in FIG. 2.

FIG. 3 is a view showing a displacement mode of the print unit 3 and schematically showing the right side surface of the printing system 1. A recovery unit 12 is provided in the rear of the printing system 1. The recovery unit 12 has a function of recovering discharge performance of the printheads 30. For example, a cap mechanism that caps the ink discharge surface of each printhead 30, a wiper mechanism that wipes the ink discharge surface, and a suction mechanism that sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1, at which the print unit 3 is indicated by a solid line, and a recovery position POS3, at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

Transfer Unit

The transfer unit 4 will be described with reference to FIG. 1. The transfer unit 4 includes a transfer drum 41 and a pressurizing drum 42. Each of these drums is a rotating member that rotates about a rotation axis in the Y direction and has a cylindrical outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area in which preprocessing is performed on the transfer member 2 before the print unit 3 discharges ink and an area in which the peripheral unit 5A performs processing. In this embodiment, a reactive liquid is applied. The discharge area R2 is a formation area in which the print unit 3 forms an ink image by discharging ink to the transfer member 2. The processing areas R3 and R4 after discharge are processing areas in which processing is performed on the ink image after ink discharge. The processing area R3 after discharge is an area in which the peripheral unit 5B performs processing, and the processing area R4 after discharge is an area in which the peripheral unit 5C performs processing. The transfer area R5 is an area in which the transfer unit 4 transfers the ink image on the transfer member 2 to the print medium P. The processing area R6 after transfer is an area in which post processing is performed on the transfer member 2 after transfer and an area in which the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer, but may be an accumulative member of a plurality of layers. If the transfer member 2 is formed by the plurality of layers, it may include three layers of, for example, a surface layer, an elastic layer, and a compressed layer. The surface layer is an outermost layer having an image formation surface on which the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic, can be used appropriately. In respect of durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of these materials may be combined. It is also possible to provide an arbitrary surface shape in the surface layer.

For example, acrylonitrile-butadiene rubber, acrylic rubber, chloroprene rubber, urethane rubber, silicone rubber, or the like, can be used as a material for the compressed layer. When such a rubber material is formed, a porous rubber material may be formed by blending a predetermined amount of a vulcanizing agent, a vulcanizing accelerator, or the like, and further blending a foaming agent, or a filling agent, such as hollow fine particles or salt, as needed. Consequently, a bubble portion is compressed along with a volume change with respect to various pressure fluctuations, and thus, deformation in directions other than a compression direction is small, making it possible to obtain a compressed layer that is more stable in terms of transferability and durability. As the porous rubber material, there are a material having an open cell structure in which respective pores continue to each other and a material having a closed cell structure in which the respective pores are independent of each other. Either structure, however, may be used, or both of these structures may be used.

As a member for the elastic layer, the various materials, such as the resin and the ceramic, can be used appropriately. In respect of processing characteristics, various materials of an elastomer material and a rubber material can be used. More specifically, for example, fluorosilicone rubber, phenyl silicon rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or to maintain resilience when attached to the transfer drum 41. A woven fabric may be used as a reinforce layer. The transfer member 2 can be manufactured by arbitrarily combining the respective layers formed by the materials described above.

The outer peripheral surface of the pressurizing drum 42 is pressed against the transfer member 2. At least one grip mechanism that grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source, such as a motor that drives them. A driving force can be delivered by a transmission mechanism, such as a gear mechanism.

Peripheral Unit

The peripheral units 5A to 5D are arranged around the transfer drum 41. In this embodiment, the peripheral units 5A to 5D are an application unit, an absorption unit, a heating unit, and a cleaning unit in order.

The application unit 5A is a mechanism that applies the reactive liquid onto the transfer member 2 before the print unit 3 discharges ink. The reactive liquid is a liquid that contains a component increasing an ink viscosity. An increase in ink viscosity here means that a coloring material, a resin, and the like, that form the ink react chemically or absorb physically by contacting the component that increases the ink viscosity, recognizing the increase in ink viscosity. This increase in ink viscosity includes not only a case in which an increase in viscosity of entire ink is recognized, but also a case in which a local increase in viscosity is generated by coagulating some of components, such as the coloring material and the resin that form the ink.

The component that increases the ink viscosity can use, without particular limitation, a substance, such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like, can be given as a mechanism that applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism that absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content, such as a coloring material or a resin included in the ink with respect to the liquid component, by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or less than 10 μm in order to suppress adherence of an ink solid content to the liquid absorbing member. The pore size here refers to an average diameter and can be measured by a known means, such as a mercury intrusion technique, a nitrogen adsorption method, a scanning electron microscope (SEM) image observation, or the like. Note that the liquid component does not have a fixed shape, and is not particularly limited if it has fluidity and an almost constant volume. For example, water, an organic solvent, or the like, contained in the ink or reactive liquid can be given as the liquid component.

The heating unit 5C is a mechanism that heats the ink image on the transfer member 2 before transfer. A resin in the ink image melts by heating the ink image, improving transferability to the print medium P. A heating temperature can be equal to or greater than the minimum film forming temperature (MFT) of the resin. The MFT can be measured by an apparatus that complies with a generally known method, such as JIS K 6828-2: 2003 or ISO 2115: 1996. From the viewpoint of transferability and image robustness, the ink image may be heated at a temperature greater than the MFT by 10° C. or more, or may further be heated at a temperature greater than the MFT by 20° C. or more. The heating unit 5C can use a known heating device, for example, various lamps, such as infrared rays, a warm air fan, or the like. An infrared heater can be used in terms of heating efficiency.

The cleaning unit 5D is a mechanism that cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like, as needed. A known shape, such as a roller shape or a web shape, can be used for a cleaning member used for cleaning.

As described above, in this embodiment, the application unit 5A, the absorption unit 5B, the heating unit 5C, and the cleaning unit 5D are included as the peripheral units. Some of these units may, however, each be provided with the cooling function of the transfer member 2 or added with a cooling unit. In this embodiment, the temperature of the transfer member 2 may rise by heat of the heating unit 5C. If the ink image exceeds the boiling point of water as a prime solvent of ink after the print unit 3 discharges ink to the transfer member 2, performance of liquid component absorption by the absorption unit 5B may degrade. It is possible to maintain the performance of liquid component absorption by cooling the transfer member 2, such that the discharged ink is maintained below the boiling point of water.

The cooling unit may be an air blowing mechanism that blows air to the transfer member 2, or a mechanism that brings a member (for example, a roller) into contact with the transfer member 2 and cools this member by air-cooling or water-cooling. The cooling unit may be a mechanism that cools the cleaning member of the cleaning unit 5D. A cooling timing may be a period before application of the reactive liquid after transfer.

Supply Unit

The supply unit 6 is a mechanism that supplies ink to each printhead 30 of the print unit 3. The supply unit 6 may be provided on the rear side of the printing system 1. The supply unit 6 includes a reservoir TK that reserves ink for each kind of ink. Each reservoir TK may include a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism that deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Conveyance Apparatus

The conveyance apparatus 1B is an apparatus that feeds the print medium P to the transfer unit 4 and discharges, from the transfer unit 4, the printed product P' on which the ink image is transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit on which the plurality of print media P are stacked and a feeding mechanism that feeds the print media P one by one from the stacking unit to the uppermost conveyance drum 8. Each of the conveyance drums 8 and 8*a* is a rotating member that rotates about the rotation axis in the Y direction and has a cylindrical outer peripheral surface. At least one grip mechanism, which grips the leading edge portion of the print medium P (or printed product P'), is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-sided printing, it is not transferred to the conveyance drum 8 adjacent on the downstream side, but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

Post Processing Unit

The conveyance apparatus 1B includes post processing units 10A and 10B. The post processing units 10A and 10B are mechanisms that are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. For example, coating that aims at protection, glossy, and the like, of an image on the image printed surface of the printed product P' can be given as one of processing contents. For example, liquid application, sheet welding, lamination, and the like, can be used as coating contents.

Inspection Unit

The conveyance apparatus 1B includes inspection units 9A and 9B. The inspection units 9A and 9B are mechanisms that are arranged on the downstream side of the transfer unit 4, and inspect the printed product P'.

In this embodiment, the inspection unit 9A is an image capturing apparatus that captures an image printed on the printed product P' and includes an image sensor, for example, a charge coupled device (CCD) sensor, a complementary metal oxide semiconductor (CMOS) sensor, or the like. The inspection unit 9A captures a printed image while a printing operation is performed continuously. Based on the image captured by the inspection unit 9A, it is possible to confirm a time-over change in tint, or the like, of the printed image and to determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images for every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

Control Unit

Figure 4:
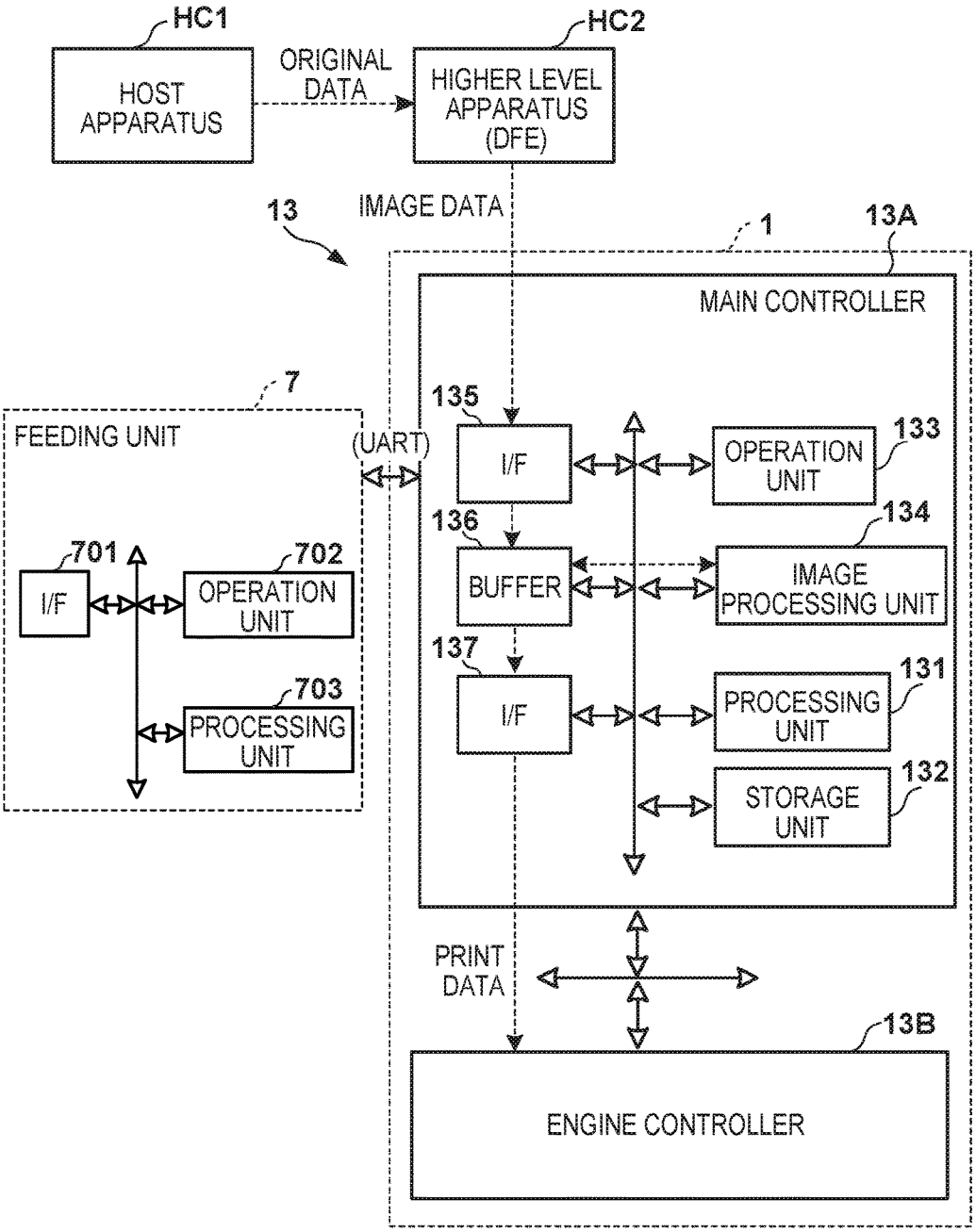
FIG. 4 is a block diagram showing a control system of the printing system in FIG. 1.
Figure 5:
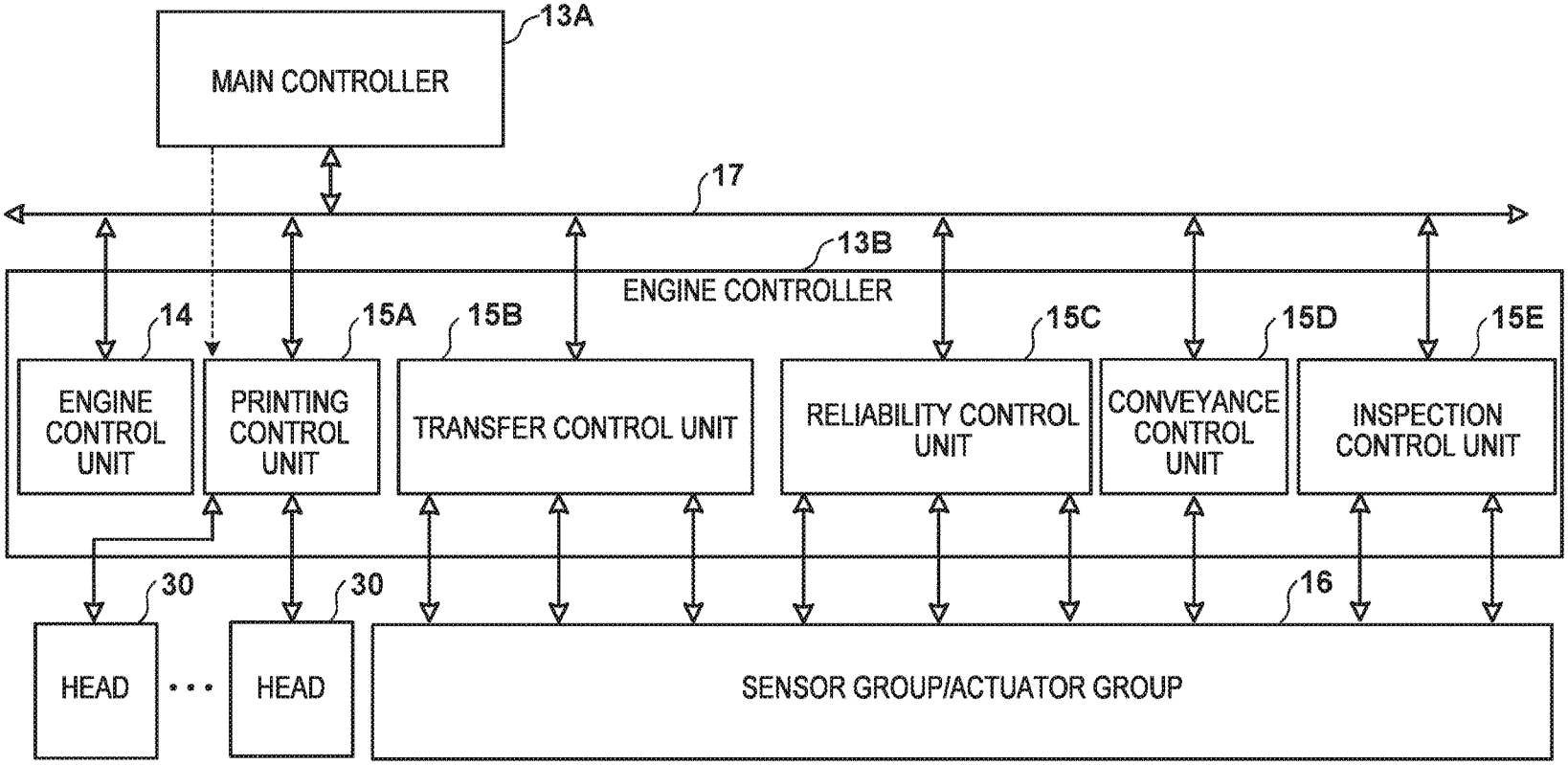
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file, such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

A main controller 13A is connected to the feeding unit 7 via a transmission path, such as Universal Asynchronous Receiver Transmitter (UART). The feeding unit 7 includes, for example, a communication interface (I/F) 701 for performing communication with the main controller 13A, an operation unit 702 that accepts adjustment of a paper feed speed by a user operation, and a processing unit 703 that controls the feeding unit 7. The processing unit 703 controls paper feed to the conveyance apparatus 1B based on, for example, information acquired from the main controller 13A by the communication I/F 701 or a user operation information accepted by the operation unit 702.

In this embodiment, the control unit 13 is roughly divided into the main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor, such as a central processing unit (CPU), that executes programs stored in the storage unit 132, and controls the entire main controller 13A. The storage unit 132 is a storage device, such as a random access memory (RAM), a read only memory (ROM), a hard disk, or a solid state drive (SSD), that stores data and the programs executed by the processing unit 131, and provides the processing unit 131 with a work area. The operation unit 133 is, for example, an input device, such as a touch panel, a keyboard, or a mouse, and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine. Note that the main controller 13A and the engine controller 13B can be connected to each other not only by the communication I/F 137 but also by an internal local area network (LAN) 17. At this time, for example, a communication path used by the communication I/F 137 can be a communication path capable of performing large-capacity communication that is used for transmission of print data. The internal LAN 17 can be a relatively low-capacity communication path for transmission of a control command, and the like. Note that the internal LAN 17 may be formed by a communication interface with high reliability such that a predetermined command is transmitted at a predetermined timing with a high success probability.

As shown in FIG. 5, the engine controller 13B includes control units 14 and 15A to 15E, and acquires a detection result of a sensor group/actuator group 16 of the printing system 1 and performs driving control. Each of these control units includes a processor, such as a CPU, a storage device, such as a RAM or a ROM, and an interface with an external device. Furthermore, these control units can be interconnected via the internal LAN 17. These control units may be configured to communicate with each other using, for example, another communication path (not shown) without intervention of the internal LAN 17. Note that the division of the control units is an example, and a plurality of subdivided control units may perform some of control operations or, conversely, the plurality of control units may be integrated with each other, and one control unit may be configured to implement their control contents.

The engine control unit 14 controls the entire engine controller 13B. The printing control unit 15A converts print data received from the main controller 13A into raster data, or the like, in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism that moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, and an image sensor. The actuator group includes a motor, an electromagnetic solenoid, and an electromagnetic valve.

Operation Example

Figure 6:
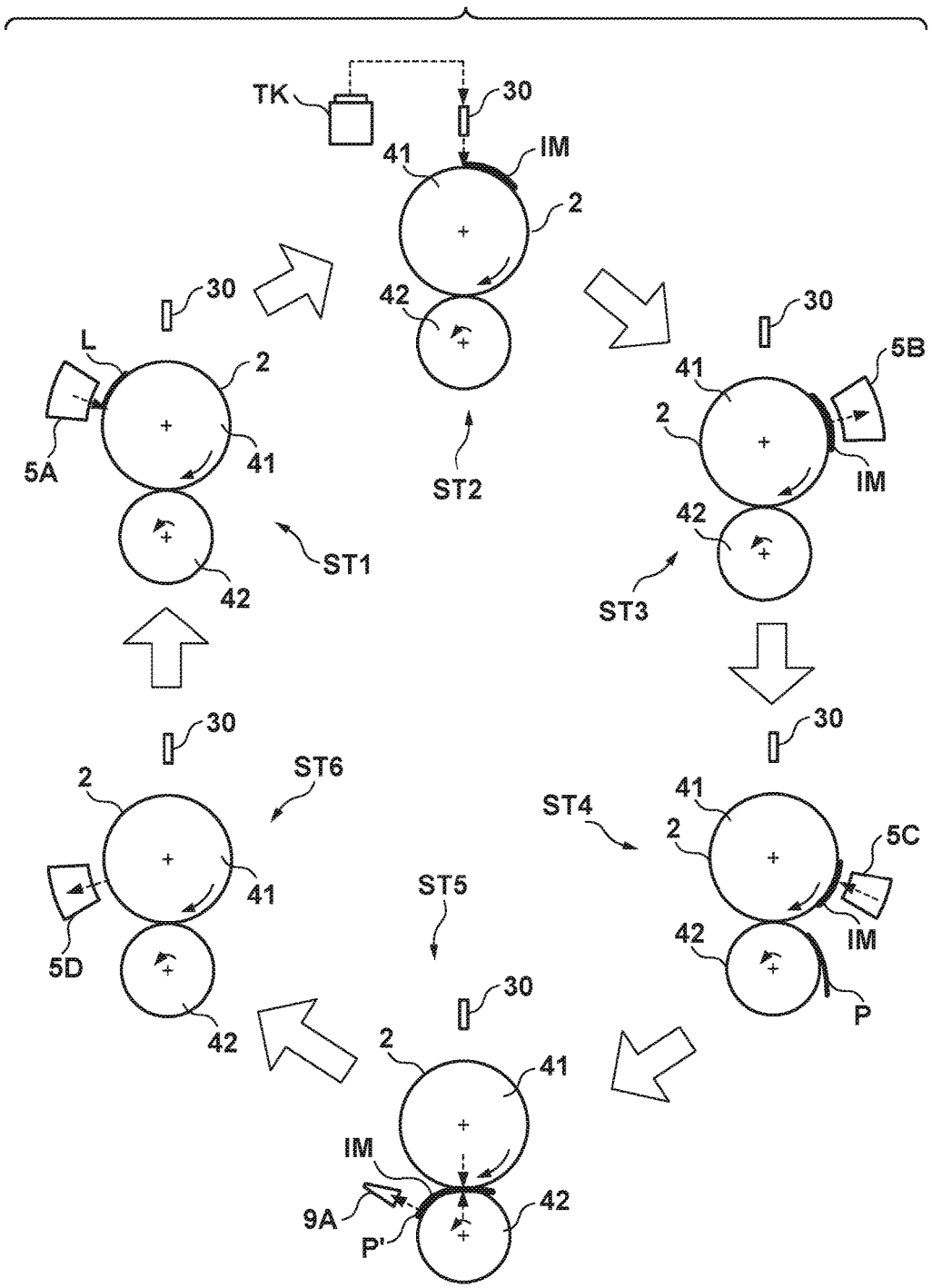
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion on the transfer member 2, on which the reactive liquid L is applied, moves along with the rotation of the transfer drum 41. When the portion on which the reactive liquid L is applied reaches under the printhead 30, ink is discharged from the printhead 30 to the transfer member 2, as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion, on the transfer member 2, on which the ink image IM is formed, reaches the cleaning unit 5D, it is cleaned by the cleaning unit 5D, as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for easy understanding. It is possible, however, to continuously perform transfer of the ink image IM to the plurality of print media P in one rotation of the transfer member 2.

Figure 7:
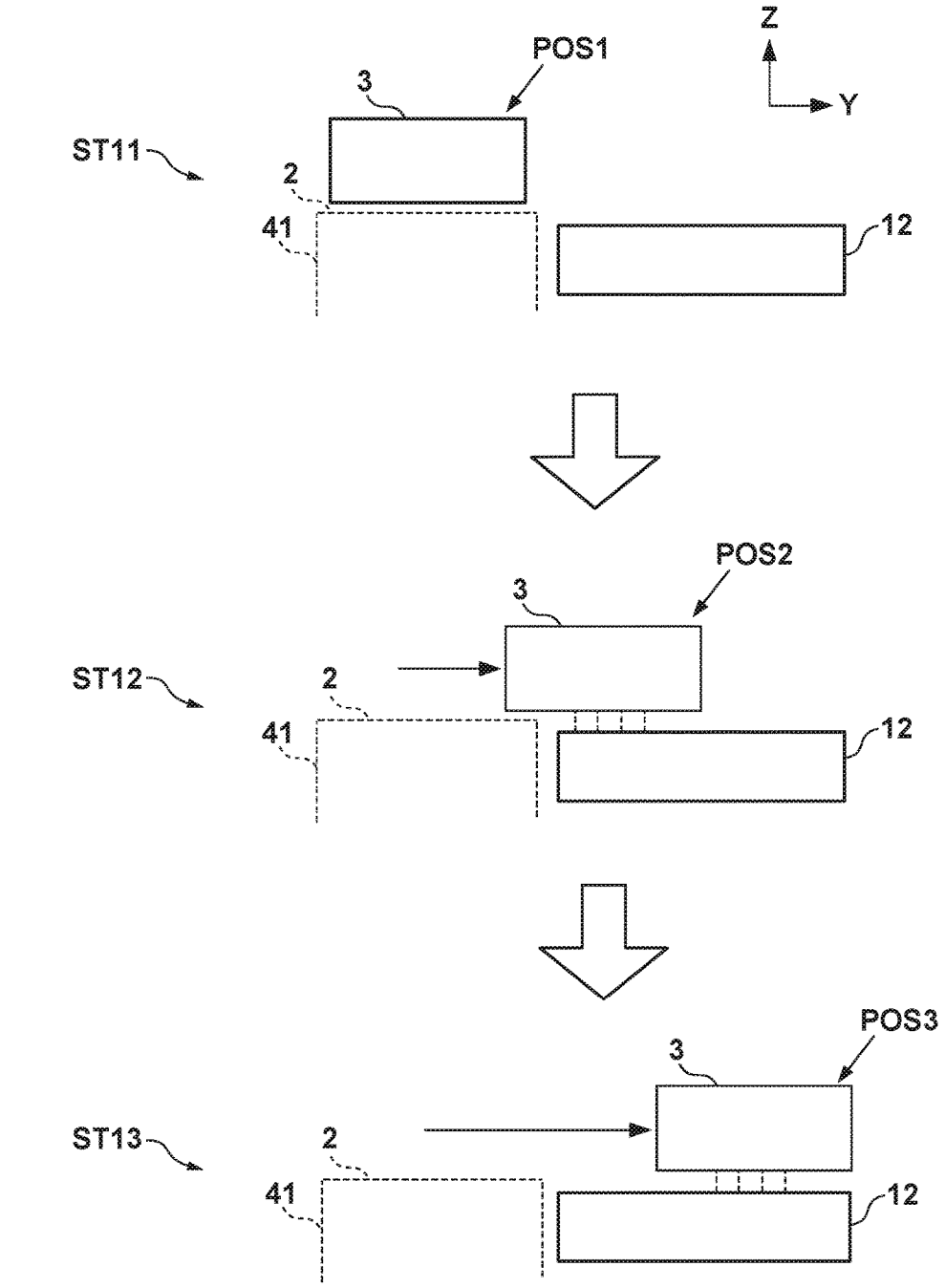
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

As described above, the printing system 1 according to this embodiment can continuously transfer the ink image IM to the plurality of print media P in one rotation of the transfer member 2. Note that the print medium P may be a cut sheet of paper or another medium obtained for each printing operation of one image. In this case, if it is possible to transfer an image to N pieces of print media P in one rotation of the transfer member 2, in order to transfer the image continuously, it is necessary to complete, for example, image processing for ink image formation within 1/N of the time required for one rotation of the transfer member 2 (to be referred to as a "unit transfer time" hereafter). The time taken to perform image processing in the higher level apparatus HC2 and the main controller 13A may, however, become longer than the unit transfer time. Consider, for example, a case in which, when the higher level apparatus HC2 and the main controller 13A are designed to complete image processing for image data of 600 dpi within the unit transfer time, image data of 1,200 dpi is processed by these apparatuses. With respect to images of the same paper size, the processing amount of image processing for image data of 1,200 dpi is about four times greater than that for image data of 600 dpi. Thus, the processing time can increase up to about four times. Therefore, image processing for the image data of 1,200 dpi may take about four times the unit transfer time. In addition to the image processing, if the amount of image data increases, the processing time can increase in accordance with print conditions represented by the time taken to process image data. For example, a data transfer time is accordingly prolonged depending on a data transfer line.

In this case, if the transfer member 2, the conveyance apparatus 1B, and the like, continue the printing operation, the print medium P on which the ink image IM is transferred and the print medium P on which no ink image IM is transferred are mixed and output, and thus, the user needs to sort them. To the contrary, if the image processing, and the like, are not complete, the operations of the transfer member 2, the conveyance apparatus 1B, and the like, can be stopped. If, for example, image processing, and the like, for one image data are not complete, the operations of the transfer member 2, the conveyance apparatus 1B, and the like, are stopped. In an arrangement in which image processing, and the like, for image data of 600 dpi are completed within the unit transfer time, if the image processing, and the like, do not end within the unit transfer time since image data of 1,200 dpi is a print target, the operations of the transfer member 2, the conveyance apparatus 1B, and the like, are stopped. This prevents the print medium P, on which no ink image IM is transferred, from being output. Note that if the same image is printed continuously, printing processing can be executed continuously regardless of the resolution of the image data. This is because once the image processing, and the like, are performed, the same processing need not be performed for subsequent image data. For example, if an image of 600 dpi is printed after printing the same image of 1,200 dpi on four sheets in an arrangement in which four sheets can be printed in one rotation of the transfer member 2, all these printing operations are performed continuously. That is, the image processing, and the like, for the image data of 1,200 dpi are complete at the time of printing of the first sheet in the first rotation, and the second to fourth sheets can be printed using the result of the image processing, and the like. Since the image processing, and the like, for the subsequent image data of 600 dpi are completed within the unit transfer time, it is possible to print the image data of 600 dpi by printing of the first sheet in the second rotation. If there is no section in which no printing is executed, it is unnecessary to stop the operations of the transfer member 2, the conveyance apparatus 1B, and the like. Note that if the operations of the transfer member 2, the conveyance apparatus 1B, and the like, are stopped, the activation processing of the transfer member 2, the conveyance apparatus 1B, and the like, is executed when the image processing, and the like, for the next print target image advances to a printable state, and thus, the load and time for controlling the activation processing can be required.

Furthermore, for example, the rotation speed of the transfer member 2 and the conveyance speed of the print medium P by the conveyance apparatus 1B can be decreased. For example, for image data that takes a processing time that is N times longer than the unit transfer time, the rotation speed and the conveyance speed are set to 1/N. Assume, for example, that if image data of 1,200 dpi is printed in an arrangement capable of printing image data of 600 dpi continuously at a linear velocity of 0.6 m/s, the image processing, and the like, take four times longer. In this case, the rotation speed and the conveyance speed can be decreased to 0.15 m/s, thereby executing printing. This can execute printing processing in accordance with the speed of the image processing, and the like. Note that in this case, various parameters need to be set appropriately in accordance with the decrease in rotation speed. If printing is executed under the condition that image data of 1,200 dpi and image data of 600 dpi are mixed, the image data of 600 dpi is also printed at a linear velocity according to the image data of 1,200 dpi.

Furthermore, it is possible to control the number of copies in one rotation of the transfer member 2 by processing of scheduling formation of the ink image on the transfer member 2 and conveyance of the print medium P by the conveyance apparatus 1B and thinning out the formation of the ink image and conveyance of the print medium P. That is, in a state in which the rotation speed of the transfer member 2 and the conveyance speed of the print medium P by the conveyance apparatus 1B are maintained constant and the image processing, and the like, are not complete, control is performed not to form the ink image on the transfer member 2 and not to convey the print medium P. If, for example, printing of image data of 1,200 dpi is scheduled, it is estimated that the image processing, and the like, take four times as long as the time taken for image data of 600 dpi, thereby executing printing during one of four periods in which image data can be printed. For example, if four image data can be printed in one rotation of the transfer member 2, an ink image is formed not in areas, on the transfer member 2, corresponding to the first to third sheets, but in an area corresponding to the fourth sheet. Furthermore, the conveyance apparatus 1B does not convey the paper at timings corresponding to the first to third sheets, but conveys the paper at a timing corresponding to the fourth sheet. This can execute printing processing appropriately in accordance with the speed of the image processing, and the like, without changing the settings of various parameters in the transfer member 2, the conveyance apparatus 1B, and the like, and without decreasing the print speed. In this embodiment, the following description will be provided by, particularly, paying attention to this method.

Figure 8:
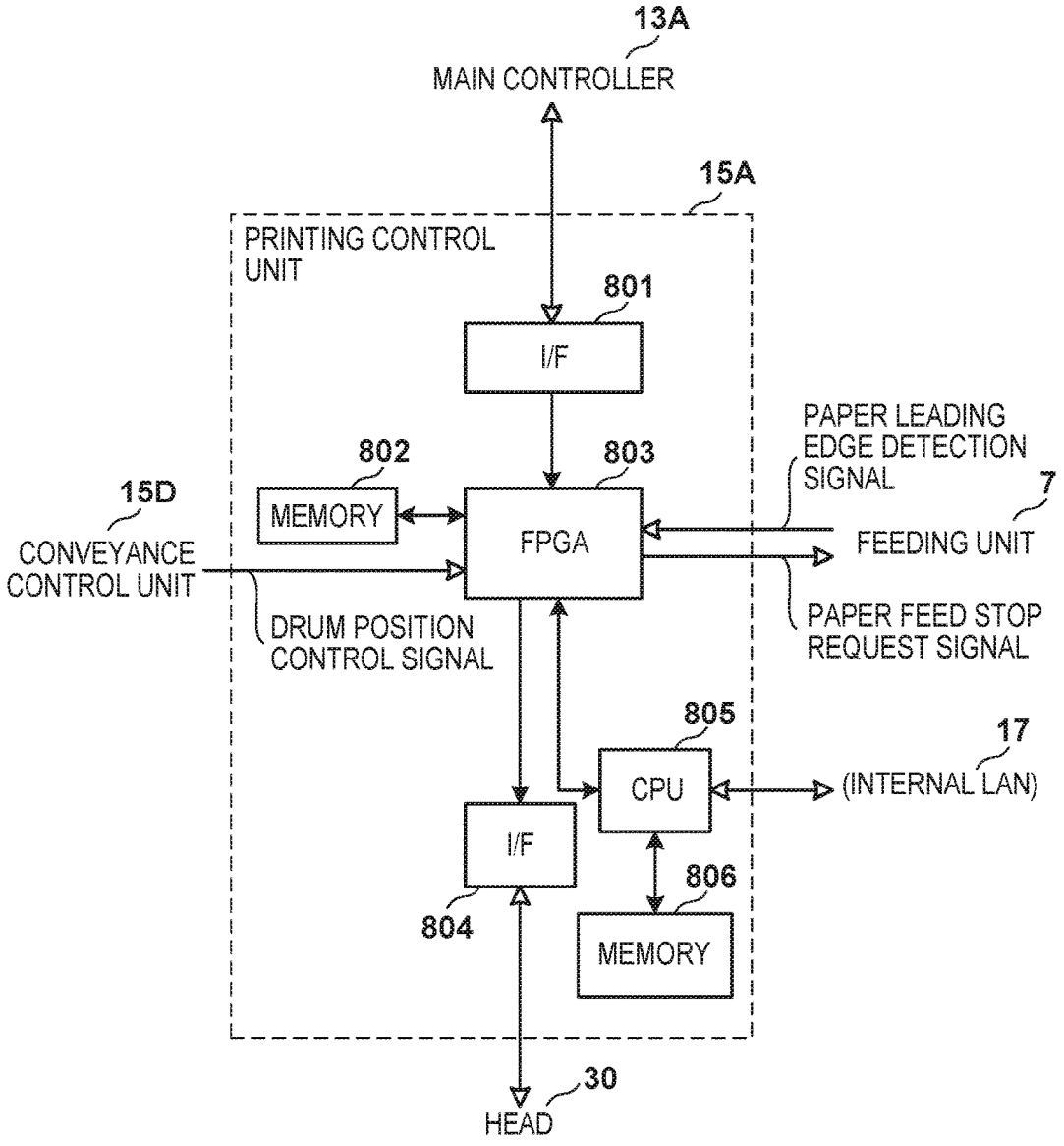
FIG. 8 is a block diagram showing an example of the arrangement of a printing control unit.

In this embodiment, in an example, the printing control unit 15A executes processing for controlling the number of copies in one rotation of the transfer member 2 based on a print condition, such as a resolution indicating the time taken to process image data. An example of the arrangement of the printing control unit 15A will be described with reference to FIG. 8. The printing control unit 15A includes, for example a Field Programmable Gate Array (FPGA) 803 and a CPU 805. For example, the FPGA 803 receives, via a communication I/F 801, print data from the main controller 13A, and accumulates it in a memory 802. The FPGA 803 controls the printheads 30 via a communication I/F 804 to discharge ink to the transfer member 2 at a timing based on a drum position control signal from the conveyance control unit 15D after performing various image processes for the print data accumulated in the memory 802. That is, the FPGA 803 specifies a rotation amount from the reference position of the transfer member 2 of the transfer drum 41, and the like, by the drum position control signal, and controls an ink discharge timing so as to print a predetermined image at a predetermined position on the print medium P. The FPGA 803 also controls ink discharge of each printhead 30 and paper feed of feeding unit 7. For example, the FPGA 803 can control the paper feed by transmitting a paper feed stop request signal to the feeding unit 7 at a timing when the paper feed should be stopped. The feeding unit 7 can execute the paper feed unless, for example, such signal is received. Note that the FPGA 803 may be configured to transmit a paper feed request signal at a timing when paper should be fed, and not to transmit such signal at a timing when paper should not be fed.

The FPGA 803 can execute various processes based on instructions from the CPU 805. The CPU 805 is connected to the internal LAN 17 to receive a control command, or the like, from another control unit and to transmit a control command, or the like, to another control unit. The CPU 805 is connected to a memory 806 to execute processing in accordance with various control commands, or the like, using, for example, the memory 806 as a working memory. For example, the CPU 805 can generate, based on information of the print condition, such as a resolution concerning print target image data acquired from the main controller 13A, a schedule to be used to actually execute printing, and to notify the FPGA 803 of information about the schedule. The information of the print condition, such as a resolution concerning the image data, can be added, in a form of a header, to the values of pixels forming the image. The schedule used to execute printing may be in a form of a Print Order Table (POT) (to be described later). Furthermore, for example, an output resolution is determined based on an instruction from the user when inputting original data to the higher level apparatus (DFE) HC2, and information of the resolution and information of the number of copies are sent to the printing control unit 15A first. Then, the printing control unit 15A can generate a schedule based on these pieces of information. Thus, since the main controller 13A transfers print data to the printing control unit 15A, it is possible to generate a schedule on which the time taken for the DFE and the main controller 13A to process the data is reflected. Note that the main controller 13A may generate the above-described schedule based on the print condition of the print target image data, and the CPU 805 may acquire information of the generated schedule. The CPU 805 or the main controller 13A can generate the schedule by reflecting one of the time taken for the DFE to process the original data and the time taken for the main controller 13A to process the data, or generate the schedule in accordance with both the processing times. Based on the schedule sent from the CPU 805, the FPGA 803 executes control not to feed paper or to discharge ink at a timing when no printing is executed and to feed paper and to discharge ink only at a timing when printing is executed due to the schedule. This can prevent, when image processing is not complete for, for example, image data of a high resolution in accordance with the print condition, the print medium, on which no ink image is transferred, from being conveyed, or printing processing from failing. Furthermore, the FPGA 803 may control to discharge ink, for example, only when the feeding unit 7 receives a paper leading edge detection signal indicating that the leading edge of paper (print medium P) has been detected, that is, only when the print medium P is actually conveyed. This can prevent the ink image from being unnecessarily formed on the transfer member 2 when, for example, conveyance of the print medium P fails due to paper being out, or the like, even at a timing when the feeding unit 7 should convey the print medium P. In addition, no ink image is formed on the transfer member 2, thereby making it possible to prevent ink from adhering to, for example, the pressurizing drum 42.

Note that the printing control unit 15A may be connected to the conveyance control unit 15D and the feeding unit 7 via, for example, the internal LAN 17, but may be connected to these functional units using dedicated lines. The printing control unit 15A includes the FPGA 803. The FPGA 803 may be replaced, however, by another processor, such as an Application Specific Integrated Circuit (ASIC) or a Digital Signal Processor (DSP).

Figure 9:
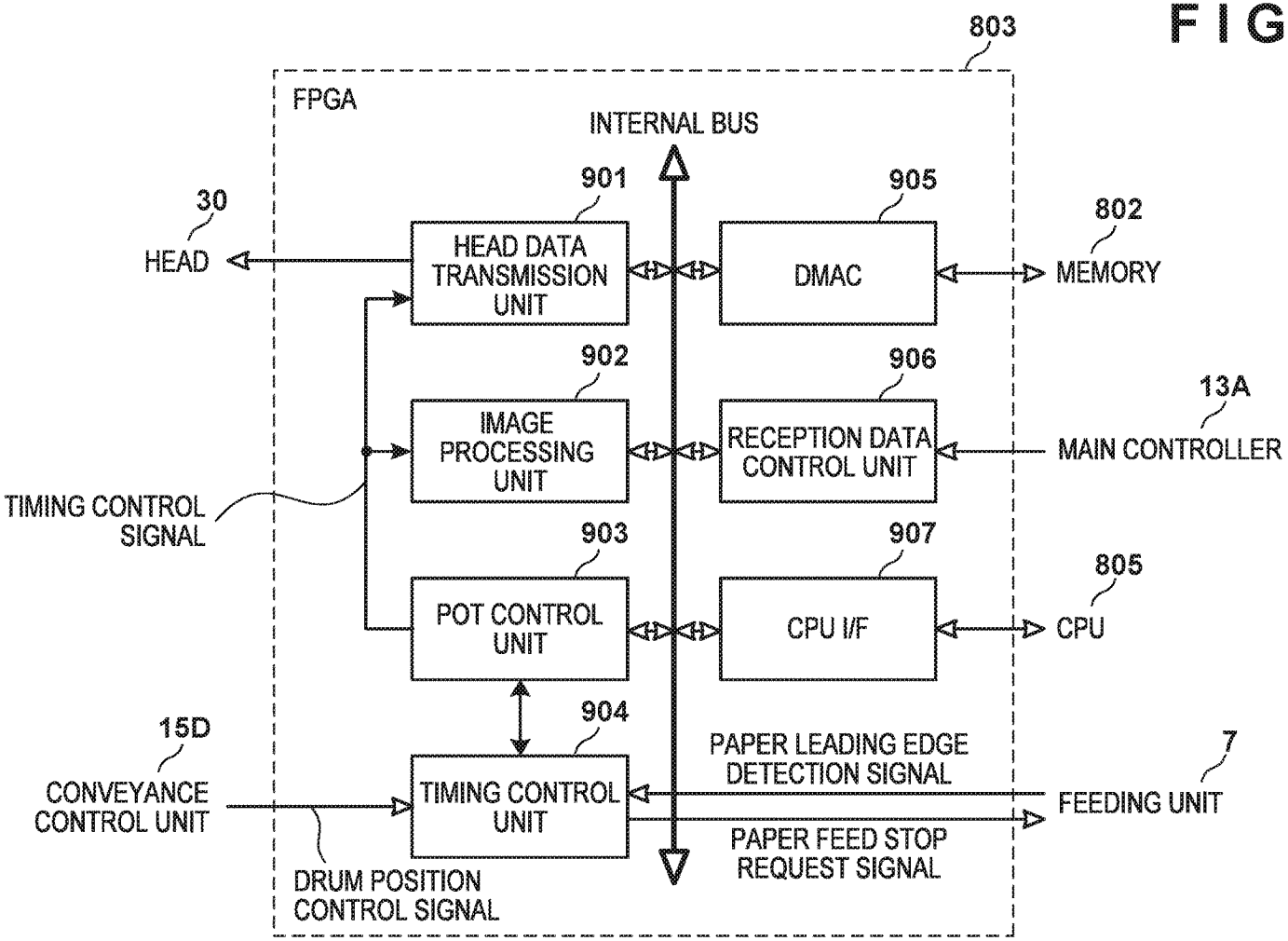
FIG. 9 is a block diagram showing an example of a functional arrangement implemented in the printing control unit.

FIG. 9 shows an example of a functional arrangement implemented by the FPGA 803. The FPGA 803 is configured to include the functions of a head data transmission unit 901, image processing unit 902, POT control unit 903, timing control unit 904, DMAC 905, reception data control unit 906, and CPU I/F 907. The FPGA 803 causes the reception data control unit 906 to acquire print data from the main controller 13A and to accumulate it. The reception data control unit 906 activates the DMAC 905 in accordance with accumulation of data of an amount that can be written in the memory 802, causing the DMAC 905 to write the accumulated data in the memory 802. The POT control unit 903 acquires a print order table (POT) indicating a print schedule from the CPU 805 via the CPU I/F 907 serving as an interface with the CPU 805.

FIG. 10 shows an example of the POT. As shown in FIG. 10, the POT is a table that associates the print ordinal number of each image with the number of copies of the image. In the POT shown in FIG. 10, after N copies of image 1 are printed, one copy of image 2 is printed. After that, N copies of image 3, one copy of image 4, one copy of image 5, and one copy of image 3 are printed, and one copy of image G is printed at the last, thereby ending printing. Note that if the POT control unit 903 acquires another POT while executing printing processing in accordance with the POT shown in FIG. 10, it can add a print schedule included in the acquired POT to the end of the current POT. The POT control unit 903 causes the image processing unit 902 to execute each image processing for allowing printing by the ink image of the print target image in accordance with the POT, and causes the head data transmission unit 901 to control the printheads 30 so as to form an ink image according to the processed image on the transfer member 2. For example, the POT control unit 903 loads the first row of the POT to set image 1 as a print target, and transmits a timing control signal to the image processing unit 902 so as to start image processing related to the print target image before forming the ink image on the transfer member 2. The POT control unit 903 transmits a timing control signal to the head data transmission unit 901 to form, at an appropriate position on the transfer member 2, an ink image related to the image having undergone the image processing. Note that the POT control unit 903 may transmit one timing control signal to both the head data transmission unit 901 and the image processing unit 902. In this case, for example, the image processing unit 902 can start the processing immediately after the signal is received, and the head data transmission unit 901 can transmit a signal for controlling each printhead 30 to discharge ink after a predetermined time elapses since the signal is received. The POT control unit 903 transmits a timing control signal to the head data transmission unit 901 so as to print N copies of image 1. After that, the POT control unit 903 loads the second row of the POT to set image 2 as a print target, and transmits a timing control signal to each of the head data transmission unit 901 and the image processing unit 902.

The timing control unit 904 can receive the drum position control signal from the conveyance control unit 15D, and provide the POT control unit 903 with information as the reference of the timing of the processing for executing ink image formation processing. For example, the POT control unit 903 generates the above-described timing control signal based on the timing provided from the timing control unit 904.

In this embodiment, for example, if the higher level apparatus HC2 and the main controller 13A are designed to complete image processing for image data of 600 dpi within the unit transfer time, image data of 600 dpi can be sequentially printed in accordance with the POT shown in FIG. 10. If a long time is required for image processing, such as printing of image data of 1,200 dpi, however, the image processing is incomplete at a print timing. In accordance with the POT shown in FIG. 10, for example, the print medium is only conveyed without transferring the ink image.

Therefore, in this embodiment, contents of the POT are set based on the print condition, such as a resolution. For example, if the image processing, and the like, for image data of 1,200 dpi take four times the unit transfer time, information indicating that there is no print target data in three of the four unit transfer times is included in the POT. Then, the POT control unit 903 transmits the timing control signal to each of the head data transmission unit 901 and the image processing unit 902 so as to print data for which the image processing, and the like, are complete during the periods in which it is indicated that there is no data.

FIG. 11 shows an example of the POT in this case. The example of FIG. 11 shows a case in which images 2 to 4 are images of 1,200 dpi and the remaining images are images of 600 dpi in the arrangement designed to complete image processing for image data of 600 dpi within the unit transfer time. Note that in this example, the image processing, and the like, for the image of 1,200 dpi end within four times the unit transfer time. In the example of FIG. 11, with respect to, for example, image 2 of 1,200 dpi, "Non" indicating that there is no print target for "three" successive print media is included in the POT and, after that, information about image 2 is included in the POT. That is, in this POT, a period taken to prepare to print image 2 of 1,200 dpi is expressed using a value "Non", and information indicating the period is expressed using a value "3" as the number of copies printable if printing is actually executed. Thus, the POT control unit 903 controls the printheads 30 to stop the formation of the ink image without stopping the rotation of the transfer member 2 based on the time taken to perform predetermined processing such as image processing with respect to printing of an image with 1,200 dpi as the print condition. Furthermore, the POT control unit 903 controls the feeding unit 7 to stop the supply of the print medium without stopping each drum associated with conveyance of the print medium based on the time taken to perform predetermined processing such as image processing. This can change the number of copies in accordance with the print condition, thereby preventing an event of, for example, conveying only the print medium from occurring. Similarly, with respect to image 3 of 1,200 dpi as well, "Non" indicating that there is no print target for "three" successive print media is included in the POT and, after that, information about image 3 is included in the POT. If two copies of image 3 are printed, it is unnecessary to execute the image processing, and the like, again in the stage of printing processing of the second copy, and thus, processing associated with the next image data can start. Therefore, for example, by starting image processing, and the like, for image 4 at the time of the printing processing of the second copy of image 3, "Non" indicating that there is no print target for "two" successive print media is included in the POT with respect to image 4 and, after that, information about image 4 is included in the POT. Note that the printing processing of the second copy of image 3 and the image processing, and the like, of image 4 need not be parallelly performed, and the image processing, and the like, of image 4 may start after the end of the printing processing of image 3. In this case, "Non" indicating that there is no print target for "three" successive print media is included in the POT and, after that, information about image 4 is included in the POT. Note that for example, upon reading out "Non" from the POT, the POT control unit 903 can perform a readout operation from the POT with respect to the image of the next print target, and send the timing control signal to the image processing unit 902 so as to execute image processing. The POT control unit 903 can stand by until the period of "Non" elapses, and send the timing control signal to the head data transmission unit 901 so as to form the ink image on the transfer member 2 in accordance with the timing of printing the image of the next print target.

Figure 13:
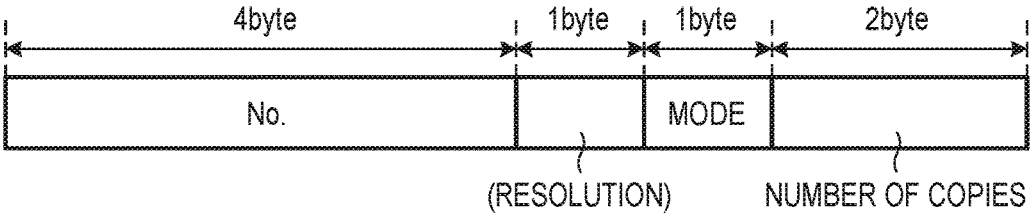
FIG. 13 is a view showing an example of the structure of information included in the print order table.

Note that the POT shown in FIG. 11 may include print condition information, such as resolution information, as shown in FIG. 12. Each of the POTs shown in FIGS. 11 and 12 stores print target data in, for example, a structure shown in FIG. 13. FIG. 13 shows an example of the structure of one print target data. As shown in FIG. 13, for example, the serial number of the print target is expressed in four bytes, a mode is expressed in one byte, and the number of copies is expressed in two bytes. In the case of FIG. 12, information indicating the resolution is expressed in, for example, one byte. Note that a value associated with each state is stored in the "mode". For example, "0x01" for a case in which there is a print target, "0x02" for a case in which there is no print target but printing does not end, that is, "Non" is included, and "0x00" for a case in which the printing processing ends are stored. Furthermore, in the "resolution", "0x01" is stored for 600 dpi, "0x02" is stored for 1,200 dpi, and "0x00" is stored for 0 dpi corresponding to a case in which the mode is "Non" or "end". Note that another value may be used as the value of the resolution. In this case, a value except for 0x00 to 0x02 is used as a value indicating the resolution.

Figure 14:
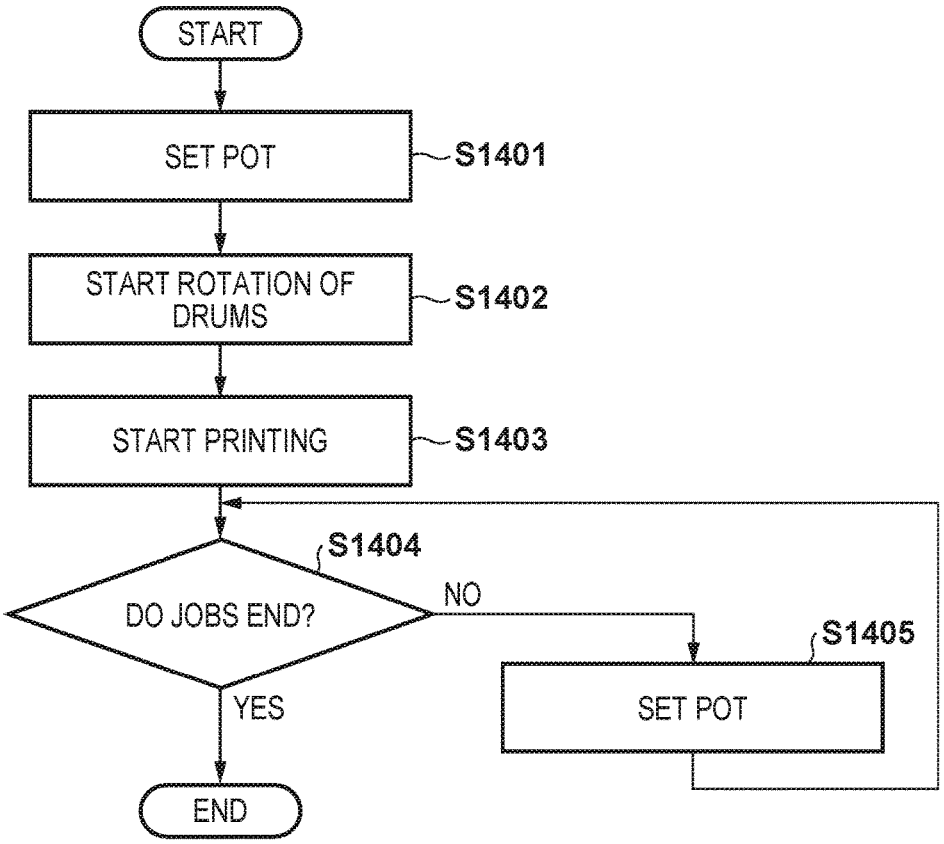
FIG. 14 is a flowchart illustrating an example of a processing sequence executed by the printing system.

An example of the sequence of the printing processing executed in accordance with the POT shown in FIG. 11 or 12 will be described with reference to FIG. 14. This processing starts due to various factors, such as power-on of the printing system, execution of a processing start operation, and occurrence of a print job. For example, the printing control unit 15A starts this processing in response to acquisition of the information from the main controller 13A. For example, the printing control unit 15A generates the above-described POT based on the information acquired from the main controller 13A or acquires the POT from the main controller 13A, and sets the POT (step S1401). The main controller 13A or the printing control unit 15A outputs a control command to another control unit via, for example, the internal LAN 17, and starts rotation of the drums (step S1402). Printing processing according to the POT set in step S1401 starts (step S1403). After that, the printing processing is continued until all jobs end (until YES is determined in step S1404). If the POT is updated by information about a new job, or the like, before all the jobs end (NO in step S1404), the current POT is updated or replaced by the new POT, thereby setting the POT (step S1405). In this printing processing, even if there is a job with a large delay caused by image processing, and the like, of data of 1,200 dpi, the rotation of the drums is not stopped, as described above. In accordance with the POT, however, during the period of "Non" corresponding to a period until the image processing, and the like, associated with the job are completed, no ink image is formed and no print medium P is conveyed. This eliminates the need to start initial processing, such as a start of drum rotation upon completion of the above-described processing, or the like, since the entire system is stopped.

Figure 15:
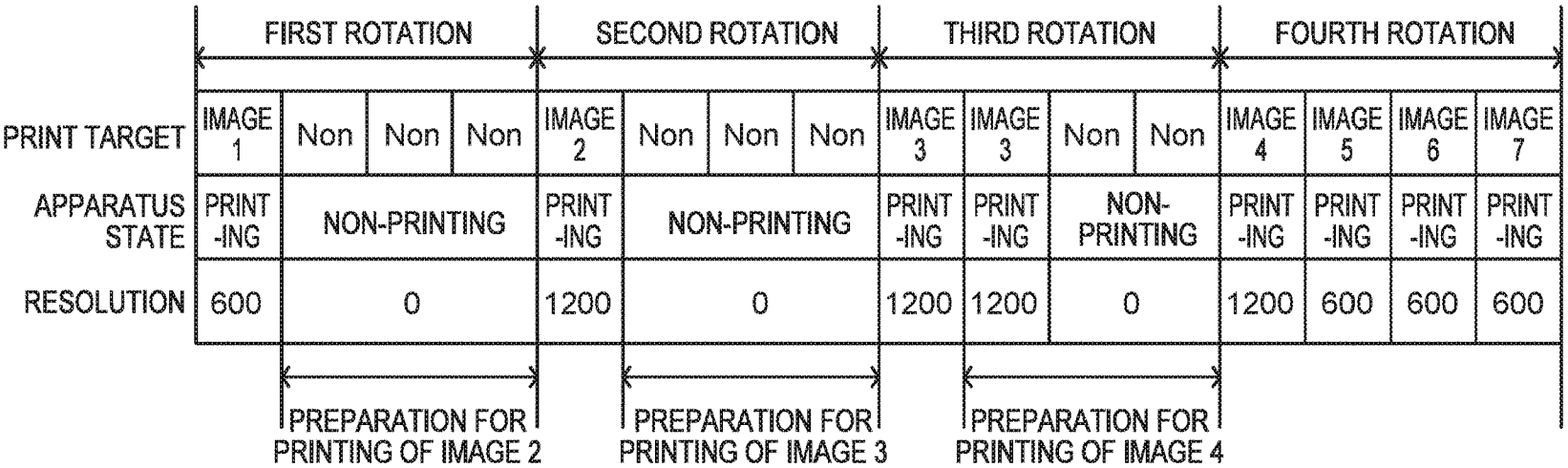
FIG. 15 is a view showing an example of processing executed by the printing system.

FIG. 15 shows an example of processing when the POT shown in FIG. 11 or 12 is used. The example of FIG. 15 shows an example of the printing system in which four sheets can be printed in one rotation of the transfer member, image processing, and the like, for an image of 600 dpi are completed within the unit transfer time, and image processing, and the like, for an image of 1,200 dpi take four times the unit transfer time. As shown in FIG. 15, for example, image 1 of 600 dpi is printed on the first sheet of the first rotation. Since image 1 has 600 dpi, a delay caused by the image processing, and the like, falls within a sufficiently small range, and thus, no period of "Non" is set. After that, the printing system attempts to print image 2 of 1,200 dpi. Since, however, a delay caused by the image processing, and the like, for image 2 is large, "Non" is set in a period for the image processing, and the like, that is, a period of the second to fourth sheets of the first rotation, and then image 2 is printed on the first sheet of the second rotation. Since image 3 is an image of 1,200 dpi, "Non" is set in a period of the second to fourth sheets of the second rotation as a period for the image processing, and the like, image 3 is printed on the first sheet of the third rotation. Note that image 3 is also printed on the second sheet of the third rotation, thereby printing two sheets in total. Note that since the image processing, and the like, for image 3 are complete at the time of the first sheet of the third rotation, image 3 is printed on the second sheet continuously from the first sheet. Since image 4 is an image of 1,200 dpi, the period of "Non" for the image processing, and the like, is set. Note that since an image processing circuit, and the like, can be in a state in which processing of the next image is possible at the time of printing of image 3 on the second sheet, image processing, and the like, associated with image 4 can be started in parallel to printing of image 3 on the second sheet. After that, image 4 is printed in a period of the first sheet of the fourth rotation. After that, since images 5 to 7 are images of 600 dpi, they are printed continuously in a period of the second to fourth sheets of the fourth rotation after printing of image 4.

Figure 16:
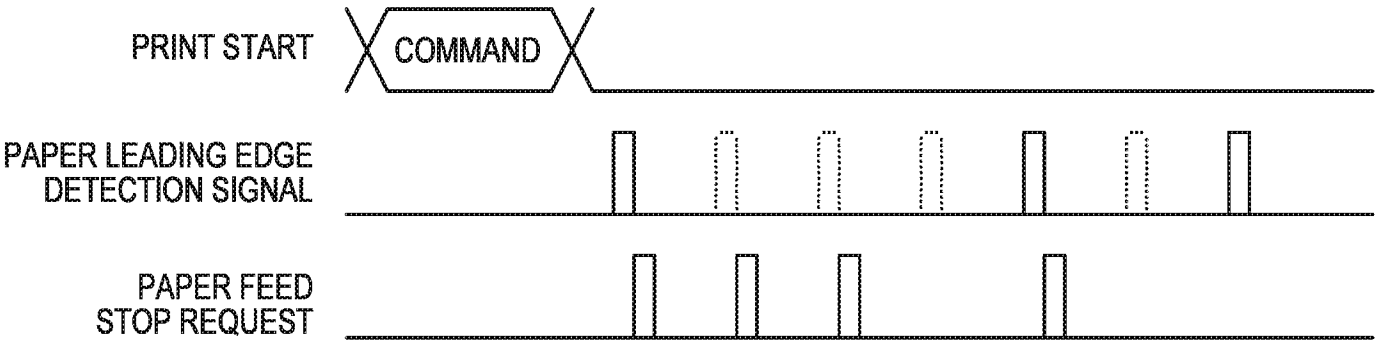
FIG. 16 is a view showing signals for paper feed stop control.

Note that the printing control unit 15A can control the printheads 30 so as to form the ink image on the transfer member 2 in response to reception of the paper leading edge detection signal from the feeding unit 7, as described above. That is, for example, if the leading edge of the print medium (paper) is not detected at a timing corresponding to the period of the first sheet of the second rotation, it is attempted to print image 2 in the period of the second sheet of the second rotation. If the leading edge of the print medium is detected at a timing corresponding to the period of the second sheet of the second rotation, the printheads 30 can be controlled to form the ink image of image 2 on the transfer member 2. Note that in this case, image processing, and the like, associated with image 3 can be started in the period of the second sheet of the second rotation, and it is thus possible to prevent printing of image 3, or the like, from being delayed due to the delay of printing of image 2. Note that if no paper leading edge detection signal is received for a predetermined period, for example, a paper out error can be output. Note that the printing control unit 15A can transmit a paper feed stop request to the feeding unit 7 to stop the feeding of the print medium in the period set for "Non". The paper feed stop request can be sent after receiving the paper leading edge detection signal at a timing corresponding to a period during which the first sheet of the first rotation, or the like, in FIG. 15 is actually printed. That is, the printing control unit 15A can transmit the paper feed stop request after confirming that printing is actually executed by receiving the paper leading edge detection signal. FIG. 16 shows examples of the control signals. Processing starts in response to input of a print command. After that, in response to feeding of the print medium to print one image, the feeding unit 7 sends the paper leading edge detection signal. After that, in accordance with, for example, the POT, no printing is executed in three periods. In this case, after receiving the paper leading edge detection signal associated with the first image, the printing control unit 15A outputs the paper feed stop request three times. This prevents three paper feeding operations. FIG. 16 shows this state by dotted lines. After that, the feeding unit 7 restarts feeding the print medium when no paper feed stop request is received. In this way, it is possible to prevent the print medium, on which no ink image is transferred, from being conveyed and output intact.

Note that as described above, for example, the rotation speed of the transfer drum 41 and the rotation speed of each drum in the transfer unit 4 are decreased, and the conveyance period of the print medium P in the feeding unit 7 is prolonged, thereby making it possible to cope with a delay caused by the image processing, and the like, at the time of printing of a high-resolution image. For example, as described above, if the image processing, and the like, for an image of 1,200 dpi require about four times the unit transfer time, the rotation speed of the transfer drum 41 and that of each drum in the transfer unit 4 are decreased to ¼ and the conveyance period of the print medium P in the feeding unit 7 is prolonged to four times. FIGS. 17A and 17B show this state. FIG. 17A shows an example of the operation of the transfer drum 41 and the operation of the printing processing at the time of a normal operation. FIG. 17B shows an example of the operation of the transfer drum 41 and the operation of the printing processing when printing of an image of 1,200 dpi is included. As shown in FIGS. 17A and 17B, if an image of 1,200 dpi is included in print target images, as compared to a case in which all print target images are images of 600 dpi, the number of images that can be printed in one rotation of the transfer member 2 is the same but one rotation takes four times longer. At this time, for example, if printing is executed at a linear velocity of 0.6 m/s in the state shown in FIG. 17A, printing is executed at 0.15 m/s in the state shown in FIG. 17B. Note that if printing of an image of 600 dpi is executed between printing operations of images of 1,200 dpi, as shown in FIG. 17B, the image of 600 dpi is also printed at the same velocity as that when the image of 1,200 dpi is printed. Note that, for example, if the POT indicates that a predetermined number or more of images of 600 dpi are continuously printed, the operation of the printing processing may be returned to the normal operation. This processing can execute the printing processing at a low velocity when an image requiring a long time for the image processing, and the like, is printed, and can execute the printing processing at a high velocity when there is no image requiring long time for the image processing, and the like.

This processing can be performed when, for example, the printing control unit 15A transmits a control command to the conveyance control unit 15D, or the like, to decrease the conveyance speed of the printing medium or the rotation speed of the transfer drum 41. Note that when this processing is performed, the printing control unit 15A can notify, for example, the transfer control unit 15B that the mode of the printing processing is changed. The transfer control unit 15B can hold transfer control parameters with respect to, for example, a normal mode of printing an image of 600 dpi and a low-velocity mode of printing an image of 1,200 dpi, and can execute printing processing by setting the parameters every time the mode is designated. For example, in the low-velocity mode, various parameters different from those in the normal mode are used to, for example, control to prevent excessive heating of the ink image by lowering the heating temperature of the heating unit 5C or a temperature for drying the print medium on which the ink image is transferred after printing. In this way, by decreasing the print speed in accordance with the time taken for the image processing, and the like, it is possible to prevent the print medium, on which no ink image is transferred by the image processing, and the like, from being output intact while keeping the transfer drum 41, and the like, in the operation state.

Note that in the above-described embodiment, the time taken for the image processing, and the like, for an image of 1,200 dpi is four times longer than the unit transfer time or the time taken for the image processing, and the like, for an image of 600 dpi. A predetermined value may be used as this value, or this value may be determined based on the actual operation. For example, by executing, in advance, test printing of an image of 600 dpi and an image of 1,200 dpi, the times taken for the respective image processes may be specified. If, for example, the time taken for the image processing for the image of 1,200 dpi falls within the range of the unit transfer time, even if the image of 600 dpi and the image of 1,200 dpi are mixed, all printing processes can be executed by the normal operation. Alternatively, if the time taken for the image processing for the image of 1,200 dpi falls within a range that is twice the unit transfer time, the period of "Non" can be shortened from the period of three sheets to the period of one sheet in, for example, the POT shown in FIG. 11 or 12.

Other Embodiments

In the above embodiment, the print unit 3 includes the plurality of printheads 30. A print unit 3 may, however, include one printhead 30. The printhead 30 may not be a full-line head, but may be of a serial type that forms an ink image while scanning the printhead 30 in a Y direction.

A conveyance mechanism of the print medium P may adopt another method, such as a method of clipping and conveying the print medium P by the pair of rollers. In the method of conveying the print medium P by the pair of rollers, or the like, a roll sheet may be used as the print medium P, and a printed product P' may be formed by cutting the roll sheet after transfer.

In the above embodiment, the transfer member 2 is provided on the outer peripheral surface of the transfer drum 41. Another method, such as a method of forming a transfer member 2 into an endless swath and running it cyclically may, however, be used. That is, the transfer member 2 may circulate a path of an arbitrary shape instead of a circle. In this case as well, the above-described embodiment can be applied by controlling to change the number of copies per period of circulation based on the print condition related to the time taken to process image data.

According to the present invention, it is possible to simply and to appropriately transfer an image to a print medium in accordance with the capability of an apparatus for processing print target data.

Embodiments of the present invention can also be realized by a computer of a system or an apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random access memory (RAM), a read only memory (ROM), a storage of distributed computing systems, an optical disk (such as a compact disc (CD), a digital versatile disc (DVD), or a Blu-ray Disc (BD)™) a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus comprising:

(A) a transfer member configured to move to cyclically pass through a formation area of an ink image and a transfer area in which the ink image is transferred to a cut sheet, the transfer member being provided so as to be capable of holding images to be formed on a plurality of cut sheets in a direction in which the transfer member passes through the formation area of the ink image;

(B) a supply unit configured to supply the cut sheet to the transfer member continuously;

(C) a data acquisition unit configured to acquire print data for forming the ink image on the transfer member, the print data being obtained when an image processing unit processes image data representing an image of a print target;

(D) a print unit configured to discharge ink to the transfer member based on the print data and to form the ink image on the transfer member in the formation area of the ink image;

(E) a transfer unit configured to transfer the ink image from the transfer member to the cut sheet supplied by the supply unit in the transfer area; and (F) a control unit configured, when continuously printing on the plurality of cut sheets of the same size:

(a) to control the transfer member to cause the transfer member to continue the movement;

(b) to control the supply unit so as to stop the supply of the cut sheet by the supply unit based on information concerning a time taken to process the image data representing the image of the print target by the image processing unit; and (c) to control the print unit so as not to form the ink image in a partial area on the transfer member that passes through the transfer area at a timing when the supply of the cut sheet to the transfer area is stopped, and to form the ink image in a remaining area.

2. The apparatus according to claim 1, further comprising (G) an information acquisition unit configured to acquire the information concerning the image of the print target before the image processing unit acquires the print data for the image of the print target.

3. The apparatus according to claim 2, wherein the control unit sets, based on the time and a number of copies of the print target, a period during which the supply of the cut sheet by the supply unit is stopped.

4. The apparatus according to claim 1, wherein the control unit sets, based on the information concerning the time taken to process the image data representing the image of the print target by the image processing unit, a period during which the supply of the cut sheet by the supply unit is stopped.

5. The apparatus according to claim 1, wherein based on information of a schedule indicating whether to execute printing based on the information concerning the time taken to process the image data representing the image of the print target, the control unit determines whether to stop the supply of the cut sheet by the supply unit.

6. The apparatus according to claim 5, wherein the control unit generates the information of the schedule based on the information concerning the time taken to process the image data representing the image of the print target.

7. The apparatus according to claim 6, wherein, in the schedule, a period during which no printing is executed is expressed by a value indicating the number of copies printable if printing is executed during the period.

8. The apparatus according to claim 1, wherein, if the supply unit does not supply the cut sheet, the control unit controls the print unit not to form the ink image even at a timing when the ink image should be formed.

9. The apparatus according to claim 1, wherein the information concerning the time taken to process the image data includes a resolution of the print target.

10. The apparatus according to claim 1, wherein the control unit controls, while maintaining a moving speed of the transfer member, the supply unit so as to stop the supply of the cut sheet by the supply unit based on the information concerning the time taken to process the image data representing the image of the print target by the image processing unit, and controls the print unit so as not to form the ink image in the partial area on the transfer member that passes through the transfer area at a timing when the supply of the cut sheet to the transfer area is stopped, and to form the ink image in the remaining area.

11. The apparatus according to claim 1, wherein, on the transfer member, a plurality of regions is provided in a direction in which the transfer member passes through the formation area of the ink image, each of the plurality of regions being capable of holding an image of a single cut sheet, and, when continuously printing on the plurality of cut sheets of the same size, the control unit controls the print unit and the supply unit, based on the information concerning the time taken to process image data representing the image of the print target by the image processing unit, so as not to form the ink image on one or more regions, of the plurality of regions, and to cause the cut sheet not to be supplied to the transfer area at a timing when the one or more of the plurality of regions pass through the transfer area, and to form the ink image on the remaining regions, of the plurality of regions, and to cause the cut sheet to be supplied to the transfer area at a timing when the remaining regions, of the plurality of regions, pass through the transfer area.

12. A control method for controlling a system for forming a printed product using a transfer member configured to move to cyclically pass through a formation area of an ink image and a transfer area in which the ink image is transferred to a cut sheet, the transfer member being provided so as to be capable of holding images to be formed on a plurality of cut sheets in a direction in which the transfer member passes through the formation area of the ink image, a supply unit configured to supply the cut sheet to the transfer member continuously, a data acquisition unit configured to acquire print data for forming the ink image on the transfer member, the print data being obtained when an image processing unit processes image data representing an image of a print target, a print unit configured to discharge ink to the transfer member based on the print data and to form the ink image on the transfer member in the formation area of the ink image, and a transfer unit configured to transfer the ink image from the transfer member to the cut sheet supplied by the supply unit in the transfer area, the method comprising:

when continuously printing on the plurality of cut sheets of the same size, controlling the transfer member to cause the transfer member to continue the movement, controlling the supply unit so as to stop the supply of the cut sheet by the supply unit based on information concerning a time taken to process the image data representing the image of the print target by the image processing unit, and controlling the print unit so as not to form the ink image in a partial area on the transfer member that passes through the transfer area at a timing when the supply of the cut sheet to the transfer area is stopped, and to form the ink image in a remaining area.

13. The method according to claim 12, further comprising acquiring the information concerning the image of the print target before the image processing unit acquires the print data for the image of the print target.

14. The method according to claim 13, wherein, in the controlling, a period during which the supply of the cut sheet by the supply unit is stopped is set based on the time and a number of copies of the print target.

15. The method according to claim 12, wherein, in the controlling, a period during which the supply of the cut sheet by the supply unit is stopped is set based on the information concerning the time taken to process the image data representing the image of the print target by the image processing unit.

16. The method according to claim 12, wherein, in the controlling, based on information of a schedule indicating whether to execute printing based on the information concerning the time taken to process the image data representing the image of the print target, it is determined whether to stop supply of the cut sheet by the supply unit.

17. The method according to claim 16, wherein, in the controlling, the information of the schedule is generated based on the information concerning the time taken to process the image data representing the image of the print target.

18. The method according to claim 17, wherein, in the schedule, a period during which no printing is executed is expressed by a value indicating the number of copies printable if printing is executed during the period.

19. The method according to claim 12, wherein, in the controlling, if the supply unit does not supply the cut sheet, the print unit is controlled not to form the ink image even at a timing when the ink image should be formed.

20. The method according to claim 12, wherein the information concerning the time taken to process the image data includes a resolution of the print target.

21. The method according to claim 12, wherein, in the controlling, while maintaining a moving speed of the transfer member, the supply unit is controlled so as to stop the supply of the cut sheet by the supply unit based on the information concerning the time taken to process the image data representing the image of the print target by the image processing unit, and the print unit is controlled so as not to form the ink image in the partial area on the transfer member that passes through the transfer area at a timing when the supply of the cut sheet to the transfer area is stopped, and to form the ink image in the remaining area.

22. The method according to claim 12, wherein, on the transfer member, a plurality of regions is provided in a direction in which the transfer member passes through the formation area of the ink image, each of the plurality of regions being capable of holding an image of a single cut sheet, and, when continuously printing on the plurality of cut sheets of the same size, the print unit and the supply unit are controlled, based on the information concerning the time taken to process image data representing the image of the print target by the image processing unit, so as not to form the ink image on one or more regions, of the plurality of regions, and to cause the cut sheet not to be supplied to the transfer area at a timing when the one or more regions, of the plurality of regions, pass through the transfer area, and to form the ink image on remaining regions, of the plurality of regions, and to cause the cut sheet to be supplied to the transfer area at a timing when the remaining regions, of the plurality of regions, pass through the transfer area.

23. A printing apparatus comprising:

(A) a transfer member configured to move to cyclically pass through a formation area of an ink image and a transfer area in which the ink image is transferred to a cut sheet, the transfer member having a plurality of regions provided in a direction in which the transfer member passes through the formation area of the ink image, each of the plurality of regions being capable of holding an image to be formed on a single cut sheet;

(B) a supply unit configured to supply the cut sheet to the transfer member continuously;

(C) a data acquisition unit configured to acquire print data for forming the ink image on the transfer member, the print data being obtained when an image processing unit processes image data representing an image of a print target;

(D) a print unit configured to discharge ink to the transfer member based on the print data and to form the ink image on the transfer member in the formation area of the ink image;

(E) a transfer unit configured to transfer the ink image from the transfer member to the cut sheet supplied by the supply unit in the transfer area; and (F) a control unit configured, when continuously printing on the plurality of cut sheets of the same size, to control the print unit and the supply unit, based on information concerning a time taken to process the image data representing the image of the print target by the image processing unit, so as not to form the ink image on the one or more regions, of the plurality of regions, and to cause the cut sheet not to be supplied to the transfer area at a timing when the one or more regions, of the plurality of regions, pass through the transfer area, and to form the ink image on remaining regions, of the plurality of regions, and to cause the cut sheet to be supplied to the transfer area at a timing when the remaining regions, of the plurality of regions, pass through the transfer area, while continuing the movement of the transfer member.

* * * * *